US005947180A

United States Patent [19]

Seyer et al.

[11] Patent Number: 5,947,180

[45] Date of Patent: Sep. 7, 1999

[54] RISING PIPE FOR LIGHT METAL MELTS

[75] Inventors: Johannes Seyer, Rödental; Bernhard Freudenberg, Coburg, both of Germany

[73] Assignee: Bayer Aktiengesellschaft, Leverkusen, Germany

[21] Appl. No.: 08/933,296

[22] Filed: Sep. 18, 1997

[30] Foreign Application Priority Data

Sep. 25, 1996 [DE] Germany ..... 196 39 358

[51] Int. Cl.[6] ..... B22D 17/00

[52] U.S. Cl. ..... 164/119; 164/306

[58] Field of Search ..... 164/119, 306, 164/133, 337; 222/606, 607

[56] References Cited

U.S. PATENT DOCUMENTS 3,529,753 9/1970 Mack ..... 164/306

4,143,687 3/1979 Belloci ..... 164/155.4

*Primary Examiner*—Kuang Y. Lin

*Attorney, Agent, or Firm*—Sprung Kramer Schaefer & Briscoe

[57] ABSTRACT

In a low pressure die casting apparatus, the properties of the rising pipe of sintered ceramic material for light metal melts is improved by a covering of heat-resistant material surrounding the upper part of the rising pipe.

6 Claims, 1 Drawing Sheet

RISING PIPE FOR LIGHT METAL MELTS

BACKGROUND OF THE INVENTION

The present invention relates to a rising pipe of sintered ceramic material for light metal melts. Such rising pipes are used in low-pressure casting for light metal melts, in particular aluminium and aluminium alloys, e.g. to DIN 1725, sheet 2, and related special alloys. In these processes the light metal melt is located in a sealed, thermally insulated container out of which the melt is fed into the metallic mold (die) via a rising pipe. After cooling of the mold and solidification of the melt in the mold the gas space above the melt is relieved of pressure, so that the melt contained in the rising pipe flows back into the container. In the gas space above the melt there are further located heating rods, which maintain the melt temperature in the container. In general heating rods of silicon carbide are used.

Whereas previously rising pipes of cast iron protected at the surface by a ceramic coating were used, the latter have been replaced in recent times by rising pipes of ceramic materials such as silicon nitride or aluminium titanate. Problems which arise through mechanical stresses in the flange areas by virtue of the brittleness of the ceramic material can be largely prevented by suitable shaping depending upon the particular material used. It is found, however, that the life of ceramic rising pipes has been limited due to the formation of certain types of cracks. These cracks are not caused purely by mechanical loading in the flange area or purely by shock or impact. Detailed investigations of these types of crack, which occur in particular in the upper third of the rising pipe above the melt level, have shown that they are caused by a combination of thermomechanical fatigue and chemical attack. The thermomechanical fatigue results from extreme and sharp temperature variations, which are caused by the thermal radiation arising from the heating (temperature above the melt temperature), the filling of the rising pipe with the melt and the loading of the gas space above the melt with relatively cool pressure gas. Air is frequently used as pressure gas, for reasons of economy, particularly in the case of magnesium-free melts. Moreover air is sucked in during the dropping of the melt from the casting mouthpiece level of the mold onto the melt level. The interaction of metal vapour with oxygen above the melt level, even when nitrogen is used as pressure gas, and only minor amounts of oxygen are present, leads to a chemical attack on the rising pipe.

SUMMARY OF THE INVENTION

It has now been found that the formation of cracks based on thermomechanical fatigue and chemical attack can be largely prevented if the rising pipe is surrounded above the liquid level with a skirt of ceramic material.

The present invention accordingly provides a rising pipe of sintered ceramic material for light metal melts, which is provided with a covering of heat-resistant, refractory material surrounding the upper part of the rising pipe.

DETAILED DESCRIPTION

The covering preferably has a lower thermal conductivity than the sintered ceramic material.

Suitable ceramic materials which can be used as the rising pipe materials in accordance with this invention are graphite base ceramics (e.g. clay-graphite), SiC base ceramics (e.g. oxide-bonded, nitride-bonded, sintered SiC, SiSiC), aluminium titanate ceramics (e.g. aluminium titanate-mullite) and other oxidic materials, e.g. $SiO_2$ base ceramics, or silicon nitride base ceramics (e.g. silicon nitride, sialon). Aluminium titanate ceramic is preferably used according to the invention, in particular as described in U.S. Pat. No. 5,288,672 and U.S. Pat. No. 5,153,153.

The covering can be produced by the spraying on of a fibre and/or particle dispersion in a thermally or hydraulically curable binder. Ceramic powders are suitable as particle materials and glass fibres or ceramic fibres are suitable as fibre materials. Ceramic cements, e.g. those based on calcium aluminate, are suitable as binders.

The covering can in addition be produced by wrapping the rising pipe with ceramic paper, ceramic fibre felt or glass fibre fabric. Such wrappings can be fixed in place by means of stainless steel welding wire or ceramic cements, wherein the fixing takes place preferably in the upper region. It is further possible to push over the rising pipe a glass fibre fabric hose, which by virtue of its manner of weaving is elastically extensible.

A further method of producing the covering consists in casting around the green body (precursor of the pipe from slip casting prior to sintering) for the rising pipe, that is to say during the manufacture of the rising pipe, a porous second slip is applied. The porous slip can be produced from the same ceramic material as the rising pipe, wherein the porosity can be produced by use of a higher proportion of organic slip constituents.

According to a further embodiment the covering consists of a sleeve which can be pushed onto the rising pipe, which sleeve is formed from a fibre mat filled with a hydraulically or thermally curable binder or from a fibre felt filled with the binder.

Figure 1:
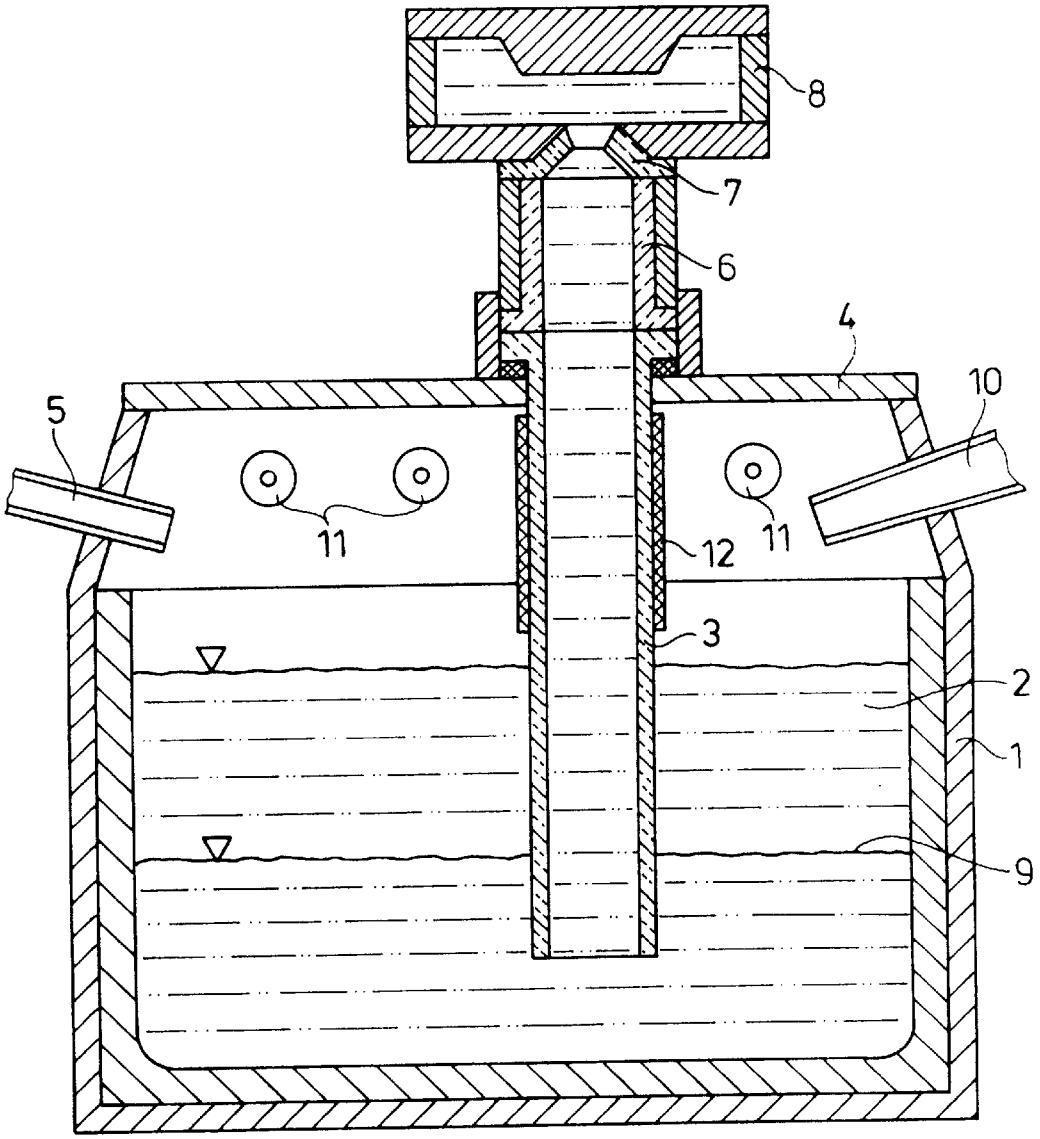
FIG. 1 is a cross-sectional drawing of a thermally insulated melt container having a rising pipe which has been provided with a ceramic covering of the invention.

The invention will be explained in detail below with reference to FIG. 1:

FIG. 1 shows a thermally insulated container 1, in which a light metal melt 2 is located. The ceramic rising pipe 3 is immersed with its bottom end in the melt 2 and passes through the insulating covering 4. The pressure above the melt 2 can be increased by means of a gas supplied through pressure gas line 5, which causes the melt to be conveyed into the die 8 through the rising pipe 3, the connecting pipe 6 and the sprue opening 7. After cooling of the die 8 the pressure above the melt 2 is reduced or relieved, so that the melt remaining in connecting pipe 6 and in rising pipe 3 drops back into container 1. The die is then opened, the light metal casting removed, the die closed, optionally after cleaning, and the gas space above the melt pressurized once again to repeat the cycle. Depending on the size of the casting, the melt level is after about 5 to 50 die fillings reduced to a level just above the bottom opening of the rising pipe. Container 1 is then refilled with melt through melt inlet 10. Silicon carbide heating rods 11 are optionally provided above the melt in order to maintain the melt temperature.

In order to prevent thermomechanical fatigue and/or chemical attack, the ceramic rising pipe 3 is, according to the invention, provided above the melt level with a ceramic covering 12.

We claim:

1. A method of preventing thermalmechanical fatigue of a sintered ceramic rising pipe of a low pressure die casting apparatus comprising a container for a metal melt, a die and a sintered ceramic rising pipe for supplying the metal melt from the container to the die, which comprises surrounding only the upper end of said sintered rising pipe above the surface of the melt with a heat resistant material having a lower thermal conductivity than the rising pipe.

2. A method of preventing chemical attack of a sintered ceramic rising pipe of a gravity die casting apparatus comprising a container for a metal melt, a die and a sintered ceramic rising pipe for supplying the metal melt from the container to the die, which comprises surrounding the upper end of said sintered rising pipe with a heat resistant material having a lower thermal conductivity than the rising pipe.

3. In a low pressure die casting apparatus comprising a container for a metal melt, a die and a sintered ceramic rising pipe for supplying the metal melt from the container to the die, said container being adapted to maintain a gas space above the metal melt contained therein, one end of said rising pipe being adapted to extend into and beneath the surface of said melt within said container and the other end of said rising pipe passing through said gas space, out of said melt container and to said die, the improvement which comprises a heat resistant material, having a lower thermal conductivity than the rising pipe, surrounding only the portion of said rising pipe passing through said gas space above the surface of the melt within the container.

4. The apparatus of claim 3 wherein said heat resistant material is produced by the spraying on of a fiber and/or particle dispersion in a thermally or hydraulically curable binder.

5. The apparatus of claim 4 wherein said fiber dispersion is a dispersion of glass or ceramic fibers, said particle dispersion is a dispersion of a ceramic powder, and said binder is a ceramic cement.

6. The apparatus of claim 3 wherein said heat resistant material surrounding said sintered ceramic rising pipe is produced by wrapping the rising pipe with ceramic paper, ceramic fibers felt or glass fibre fabric.

* * * * *

UNITED STATES PATENT AND TRADEMARK OFFICE

CERTIFICATE OF CORRECTION

PATENT NO : 5,947,180

DATED : September 7, 1999

INVENTOR(S) : Johannes Seyer, et al.

It is certified that error appears in the above-identified patent and that said Letters Patent is hereby corrected as shown below:

Column 3, line 2, after "surrounding" insert --only--.

Signed and Sealed this

Thirtieth Day of May, 2000

*Attest:*

Q. TODD DICKINSON

*Attesting Officer*

*Director of Patents and Trademarks*

UNITED STATES PATENT AND TRADEMARK OFFICE
CERTIFICATE OF CORRECTION

PATENT NO : 5,947,180

DATED : September 7, 1999

INVENTOR(S) : Johannes Seyer, et al.

It is certified that error appears in the above-identified patent and that said Letters Patent are hereby corrected as shown below:

Column 3, line 7, cancel "gravity" and substitute --low pressure--

Column 3, line 2, after "surrounding" insert --only--.

Signed and Sealed this

Thirteenth Day of June, 2000

*Attest:*

*Attesting Officer*

Q. TODD DICKINSON

*Director of Patents and Trademarks*